United States Patent [19]

Jackson et al.

[11] 3,989,523

[45] Nov. 2, 1976

[54] REDUCING APERTURE-SIZE OF SHADOW MASK IN PAINTING BLACK MATRIX CRT SCREEN

[75] Inventors: Thomas Meirion Jackson; Peter Gordon Eldridge, both of Bishop's Stortford, England

[73] Assignee: International Standard Electric Corporation, New York, N.Y.

[22] Filed: Feb. 10, 1975

[21] Appl. No.: 548,510

Related U.S. Application Data

[63] Continuation of Ser. No. 473,541, May 28, 1974, and a continuation of Ser. No. 280,926, Aug. 15, 1972.

[30] Foreign Application Priority Data

Sept. 15, 1971 United Kingdom ..... 42924/71

[52] U.S. Cl. ..... 96/36.1

[51] Int. Cl.[2] ..... G03C 5/00

[58] Field of Search ..... 96/36.1; 354/1

[56] References Cited

UNITED STATES PATENTS

| | | | |
|---|---|---|---|
| 3,600,213 | 8/1971 | Arndt | 96/36.1 |
| 3,653,901 | 4/1972 | Etter | 96/36.1 |
| 3,703,374 | 11/1972 | Okabe et al. | 96/36.1 |
| 3,736,137 | 5/1973 | Kaplan | 96/36.1 |

*Primary Examiner*—Edward C. Kimlin
*Attorney, Agent, or Firm*—John T. O'Halloran; Thomas M. Marshall

[57] ABSTRACT

A method for making a black matrix type shadow mask color television tube. A shadow mask with standard size apertures is sprayed with a black brushing cellulose lacquer while at the same time drawing air, at high velocities, through the apertures to reduce the size of said apertures. A sufficient quantity of sprayed lacquer is utilized to obtain a 10% reduction in aperture size. The mask is then utilized to coat the tube's screen, i.e. its inside face, with a colloidal graphite paint to form the required adherent black matrix surface on said screen having a plurality of holes therein. The apertures of the shadow mask are then restored to their original size by rinsing the mask in acetone to remove the lacquer coating. The resultant original size apertures of the shadow mask are utilized to form the pattern of phosphor dots on the screen overlapping the holes in the black matrix.

5 Claims, 1 Drawing Figure

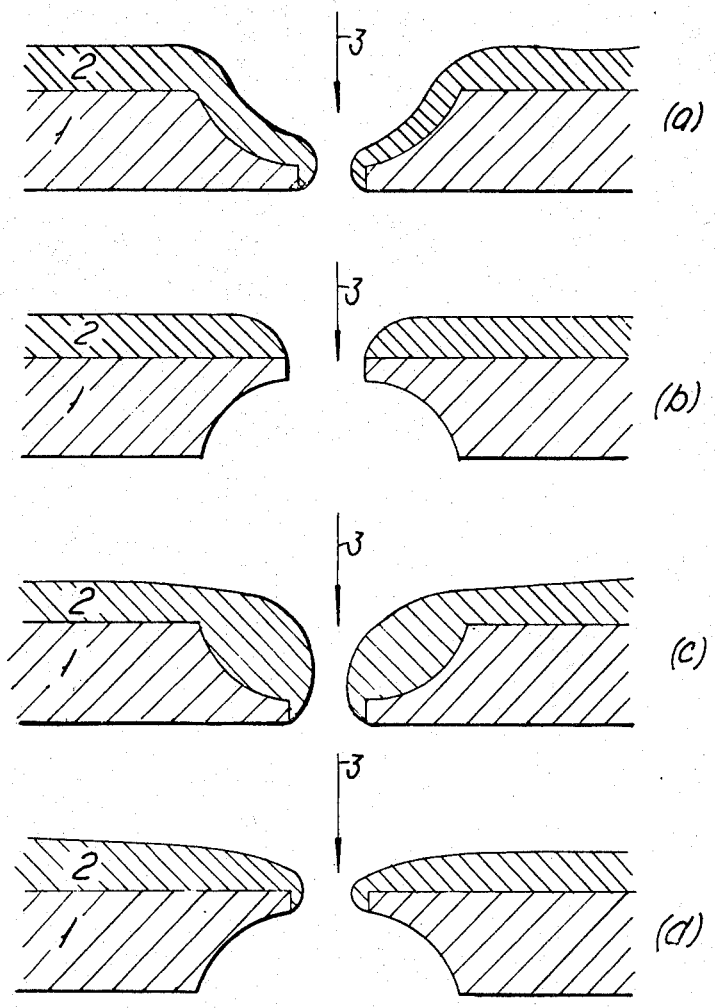
3
2
1
(a)
3
2
1
(b)
3
2
1
(c)
3
2
1
(d)

REDUCING APERTURE-SIZE OF SHADOW MASK IN PAINTING BLACK MATRIX CRT SCREEN

This is a continuation of prior application Ser. No. 473,541; filed May 28, 1974, and of an earlier original application Ser. No. 380,926; filed Aug. 15, 1972.

BACKGROUND OF THE INVENTION

This invention relates to the manufacture of color television picture tubes incorporating shadow masks, and more particularly to such tubes utilizing the so-called "Black Matrix".

One serious drawback of the standard shadow mask tube is the appearance of its picture viewed in daylight conditions or high ambient lighting conditions. In the standard shadow mask tube there are two principal factors contributing to this deficiency. Firstly, in order to accommodate beam landing errors the diameters of the phosphor dots are made larger than those of the beams, and secondly the spaces surrounding these dots is covered by a highly reflective aluminum coating. These two factors together mean that approximately 10% of the screen area is never excited by any electron beam but will nevertheless diffusely reflect ambient light and hence impair the appearance of the picture. In order to reduce this effect to acceptable limits a dark-tint face plate is used. This reduces, by a certain factor, the brightness of the reflected ambient light; but it also reduces, though only by half that factor, the brightness of the picture. Thus although there is a net improvement in appearance, the general level of picture brightness is reduced. This effect can be compensated by driving the phosphor harder, but this reduces the life of the tube. Taking this fact into consideration a face plate with approximately 50% transmission is generally considered a reasonable compromise.

A novel approach to the problem is firstly to arrange to accommodate beam landing errors by making the electron beams larger than the visible portions of the dots, and secondly to fill the space between these portions with a non-reflecting coating.

With this arrangement, if only 50% of the screen area is excited by electron beams and the remainder is substantially non-reflecting, then an 80% transmission face plate could be used, thereby providing a 54% increase in brightness with a 30% better contrast ratio between the picture and the reflected ambient light.

The arrangement can be achieved in principle by producing an appropriate pattern of holes in a black coating on the inside of the tube facce. The holes are made undersize on the standard phosphor dots which are subsequently superimposed on these holes. The diameters of the electron beams are again standard size but beam landing errors are accommodated by virtue of the fact that the effective light emitting area of each phosphor dot is restricted to that portion lying in its associated hole.

A critical step in this process is the production of the pattern of undersize holes. Since a shadow mask is unique to a tube this pattern can only be achieved by a technique which involves the temporary reduction in size of the apertures of a shadow mask.

Two methods have previously been proposed. One of these involves making the shadow mask with undersize holes which are subsequently enlarged by etching after it has been used to make the pattern of undersize holes in the black coating. The other method involves using a shadow mask with standard size holes which is then plated with a different metal to reduce their size. After the pattern of undersized holes in the black coating has been made the holes of the shadow mask are opened out again to their original size using a selective etch which will remove the plated layer, but which will not attack the underlying material from which the shadow mask is constructed. Both these methods are complicated by the fact that the enlargement of the holes has to be performed after the shadow mask has been fitted to its supporting frame and formed. It will be realized that there is a risk of trapping the etching solution between the mask and its frame which may cause contamination within the completed tube. A further disadvantage of the plating method is that it is time consuming and expensive on materials. Yet another disadvantage of methods involving the use of etching solutions is that they are liable to remove the oxide layer created during the forming of the shadow mask. If this oxide layer has to be recreated by a further heat treatment there is a serious risk that the shadow mask will slightly change its shape and thus lose its compatibility with the deposited pattern of phosphor dots.

SUMMARY OF THE INVENTION

Therefore, the main object of the invention is to provide an improved method of making a black matrix shadow mask color television tube in which the size of the holes in said mask are reduced.

According to the present invention there is provided a method of making a black matrix shadow color televesion picture tube comprising the steps of depositing a coating on a shadow mask having apertures fromed therein to reduce the size of said apertures, forming a black matrix on the tubes inside foil having a pattern of holes therein on said mask, said holes being equal in size to the size of the reduced apertures, enlarging the apertures trough said mask to their original size and depositing a pattern of phosphor dots in said now enlarged apertures of said mask on said screen which overlap the holes in said black matrix.

It is a feature of the subject invention that the holes in the shadow mask may be reduced in size using a material, such as cellulose, dissolved in a common solvent, such as acetone. Acetone will not remove the oxide layer, and although it too can readily penetrate the crevices between mask and frame, it will not react with them and therefore is less likely to be a troublesome source of contamination.

Further objects and features of this invention will become more apparent by reference to the following description taken in conjunction with the accompanying drawings in which:

BRIEF DESCRIPTION OF THE DRAWINGS

FIGS. 1*a* and 1*b* depict sectional view through the diameter of holes in a shadow mask which have been spray coated with lacquer; and FIGS. 1*c* and 1*d* depict equivalent views that are obtained when the spray coating is performed in a forced

DESCRIPTION OF THE PREFERRED EMBODIMENT

A formed shadow mask with standard sized holes is mounted so that air is drawn through the holes of the mask at high velocity using, for example, a 10 inch diameter 1½ horse power extractor fan. With the extractor fan in operation the shadow mask is spray coated with a lacquer discharged from a spray gun held a short distance, for example, approximately 8 inches, in front of the mask. A black brushing cellulose lacquer diluted with thinners in the ratio 2 parts (by volume) paint to 1 part thinners has been found satisfactory when discharged from, for example, an Aerograph Type MPS hand spray gun fitted with a number 3 jet and supplied with compressed air from a 60 p.s.i. line. The jet gives a fan shaped spray which is arranged to extend in the vertical direction, and the spray gun is mounted in a jig which permits it to pivot through a limited arc about a vertical axis. With this arrangement the spray gun is scanned a few times, for example, 12 times, across the shadow mask. between each sweep the shadow mask is shifted in a vertical direction so that the whole surface is evenly covered. The forced draft enables a second coat to be applied immediately after the first, and two coats have been found sufficient to obtain a 10% reduction in hole size. The whole coating operation can be performed in about a minute. This operating time may be compared with that for spray coatings made without a forced draft where the drying period required between consecutive coating lengthens the operating time to about half an hour. A further advantage of the use of the forced draft is that it provides approximately a three-fold reduction in the amount of lacquer required to produce a given reduction in hole size. This factor, together with the much shorter drying, is also probably responsible for the improved uniformity of hole diameter and shape that is obtained when the forced draft is used during the spraying. FIGS. 1 and 2 show typical profiles resulting from spray coating without the forced draft, while FIGS. 3 and 4 show comparable profiles obtained with the forced draft maintained during the spraying. In these figures the mask material is shown at 1, the lacquer coating at 2, and the direction of spray is indicated by arrows 3. It will be noticed that the resulting profiles depend not only upon the presence or absence of the forced draft, but also upon whether the spray strikes the mask on the small hole side or from the chamfered side. Clearly spray coating from the side opposite the chambered side is to be preferred.

After the shadow mask has been spray coated in this manner it is ready for use in the first stage of preparing the phophor screen. This is the preparation of a black matrix having a pattern of holes disposed for subsequent filling with the sets of phosphor dots. This black matrix is prepared by a similar technique to that conventionally used for the deposition of the phosphor dots. In this instance, however, the photo-sensitive mixture contains a polyvinylalcohol (p.v.a.) but no phosphor. The shadow mask is fitted in position and the screen exposed to ultraviolet light through the holes of the shadow mask.

Holes are required, not just for one phosphor color, but for all three, and so three exposures have to be made, one for each electron gun position. The triple pattern of dots is then developed in the normal way by washing so as to remove the unexposed regions of p.v.a. Nex the screen is coated with a colloidal graphite paint to form a suitable adherent black surface. The porosity of this paint enables the underlying U.V.-exposed regions of p.v.a. to be removed by washing with hydrogen peroxide. This removal of the p.v.a. dots breaks up the overlying regions of colicidal graphite, but leaves intact the rest of the black coating, which is subsequently baked on.

The holes in this black coating on the screen are undersized compared with those which would have been made had the shadow mask not first had the size of its holes reduced by the spray coating. Next these holes must be filled with their appropriate phosphors. Before this is done the holes in the shadow mask should be opened up to their original size so that small positioning errors in the deposition of the phosphor dots can be accmmodated in the resulting overlap without producing incompletely filled holes. accommodated overlap of the phosphor dots around the holes in the black matrix can be tolerated because it cannot be seen from the viewing side of the screen. The restoring of the holes in the shadow mask to their original size is achieved by rinsing in acetone to remove the lacquer coating. The spent acetone may be re-distilled for re-use.

After the holes have been restored to their original size the subsequent stages of manufacture are identical with those employed in the manufacture of a standard shadow mask tube. Thus a pattern of dots is deposited by the normal selective process involving the use of a photo-sensitive mixture containing p.v.a. and one of the phosphors exposure to U.V. light through the shadow mask, and the selective removal by washing of the unexposed regions of the deposited mixture. This cycle is repeated twice, once with each of the other two phosphors, so as to fill all the holes, and then the rest of the tube is assembled in the normal way.

While the principles of the invention has been described in connection with specific structure, it is to be clearly understood that this description is made only by way of example and not as a limitation to the scope of the invention, as set forth in the objects thereof and in the accompanying claims.

We claim:

1. A method of making a black matrix shadow mask color television picture tube having an apertured shadow mask and an adjacent faceplate screen comprising the steps of:

stray-coating an opaque material on the apertured shadow mask to reduce the size of the apertures by a predetermined amount;

providing, in addition to said spray-coating operation, a separate forced air draft at a high velocity through said apertures;

forming a black matrix having a pattern of holes therein on the adjacent surface of said screen, said holes being formed through said mask to be equal in size to the size of said reduced apertures;

enlarging the apertures in said mask to their original size; and forming a pattern of phosphor dots in said holes of said, said dots being formed through said enlarged apertures of said mask so that the dots overlap and are larger than the holes.

2. The method of making a black matrix shadow mask color television picture tube, according to claim 1, wherein said coating deposited on said shadow mask is a cellulose laquer and said forced air draft provides air through the apertures of said mask during the period in which said lacquer is being deposited on said mask to control the reduced size of said apertures.

3. The method of making a black matrix shadow mask color television picture tube, according to claim 2, wherein forming said black matrix comprises the steps of:

coating said screen with a photosensitive mixture containing polyvinylalcohol;

exposing said photosensitive mixture coated screen to ultraviolet light through the reduced apertures of said mask;

removing the regions of said photosensitive mixture not exposed to said ultraviolet light;

coating said screen with a colloidal graphite paint;

removing the portions of said photosensitive mixture exposed to said ultraviolet light and the regions of colloidal graphite overlying said ultraviolet exposed regions of said photosensitive mixture; and baking on said remaining colloidal graphite paint.

4. The method of making a black matrix shadow mask color television picture tube, according to claim 2, wherein said shadow mask apertures are enlarged to their original size by the step of rinsing said mask in acetone to remove said lacquer coating.

5. The method of claim 2 wherein said apertures have chamfered edges on one side of said mask, said coating of lacquer being deposited onto the side of said mask opposite said chamfered edges.

* * * * *